United States Patent [19]

Hellemans

[11] 4,013,204

[45] Mar. 22, 1977

[54] SELF-ADJUSTING WEB-HANDLING DEVICE

[75] Inventor: Albert Joseph Hellemans, Borgerhout, Belgium

[73] Assignee: AGFA-GEVAERT N.V., Mortsel, Belgium

[22] Filed: June 30, 1975

[21] Appl. No.: 591,314

[30] Foreign Application Priority Data

July 1, 1974 United Kingdom ..... 29118/74

[52] U.S. Cl. ..... 226/21; 118/34

[51] Int. Cl.[2] ..... B65H 25/26

[58] Field of Search ..... 118/33, 34; 226/21, 226/22, 23, 180

[56] References Cited

UNITED STATES PATENTS

| | | | |
|---|---|---|---|
| 3,078,021 | 2/1963 | Crownfield et al. | 226/21 |
| 3,090,534 | 5/1963 | Frommer et al. | 226/180 X |
| 3,602,191 | 8/1971 | Gorton, Jr. et al. | 118/33 X |

*Primary Examiner*—John P. McIntosh
*Attorney, Agent, or Firm*—William J. Daniel

[57] ABSTRACT

A self-adjusting tension-balancing roller for maintaining a substantially uniform distribution of tension across a continuously moving web, which does not cause lateral deviations of the web path while it is adjusting.

4 Claims, 2 Drawing Figures

SELF-ADJUSTING WEB-HANDLING DEVICE

Figure 1:
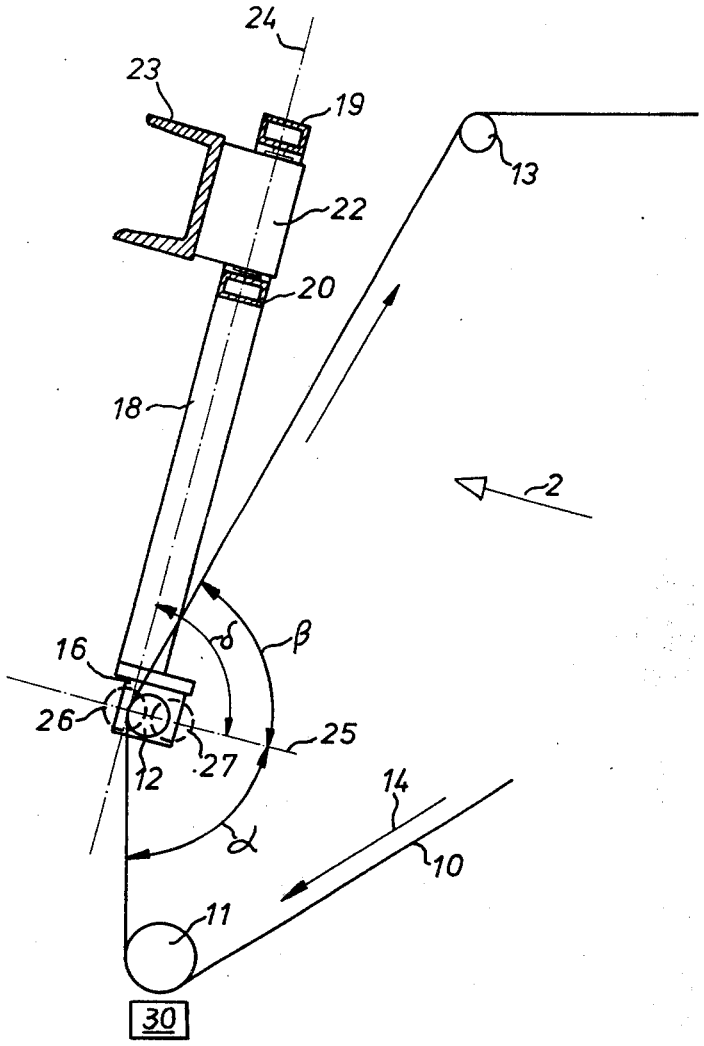

The present invention relates to a self-adjusting web-handling device.

Various attempts have been made in the prior art to provide guides and suitable constraints for flexible webs or belts which are fed from a supply roll to a take-up roll. To provide even tension across webs or belts, rollers have been mounted for pivotal movement. According to United Kingdom Pat. No. 1,325,169 in particular, a web-tracking device is provided for guiding a web between upstream and downstream constraints and having first, second and third orthogonal axes, said device comprising means defining a fixed longitudinal axis; a roller for supporting a web, said roller being rotatable at its midpoint on said fixed axis, said orthogonal axes extending through said midpoint, wherein said first orthogonal axis is the axis of the roller and is normally coincident with the said fixed axis; and means for constraining said roller for free pivotal movement about the said third orthogonal axis as a gimbal axis and for adjustment of said roller axis about the said second orthogonal axis so that said roller axis is substantially perpendicular to the approach direction of the web coming into engagement with the tracking device.

An important disadvantage of this prior art web-handling device is that the roller causes lateral deviations of the web path as the roller pivots about said gimbal axis in order to impose uniform tension across the web. Such lateral deviations of the web from its intended path cause an extra load on the mechanism(s) for the control of the web alignment. Furthermore, it may occur that the lateral deviation of a web from its path occurs very suddenly as a consequence of the instant response of the roller of the web-handling device to a locally non-uniform tension across the web. A typical cause of such locally disturbed tension pattern across the web is a splice between two webs that has been inaccurately carried out in a sense that, if both webs are located in one plane, the longitudinal axes of the webs do not run parallel to each other.

The present invention aims at providing an improved self-adjusting web-handling device for a continuously moving web which causes a uniform tension distribution across the width of the entering and leaving web spans, and which does not cause any lateral deviation of either the entering or the leaving web span upon adjustment of the web-supporting roller of the device.

More in particular, the invention aims at providing a self-adjusting web-handling device for use in combination with the web-supporting roller of a web-treating station, in particular a web-coating station. In modern coating systems such as air knife, extrusion and cascade coating, the distance between a lip of a coating head and a web which is pulled over a web-supporting roller disposed in front of the lip is very small, so that it is important to keep the web in good contact with the web-supporting roller to prevent the web from accidentally touching the lip of the coating system. A uniform tension distribution across the width of a web is a valuable aid in the maintaining of a good contact between said web and a said web-supporting roller, especially in those cases where the web shows defects such as incorrect splicing, wrinkling or buckling of a margin, etc.

According to the present invention, there is provided a self-adjusting web-handling device for providing even tension across a continuously moving web which is conveyed to come into engagement with said web-handling device along an upstream approach plane and to leave said device along a downstream exit plane at an included angle to said approach plane, said web-handling device comprising a roller mounted for free rotation and engagement by said web, and means for supporting the bearings of said roller so that the roller may be tilted about an axis of tilt which is situated halfway along the length of the roller, which is normal to the bisector of said included angle, and coincides with the tangent to the roller periphery at the side of the roller where the web is in engagement with the roller.

Figure 2:
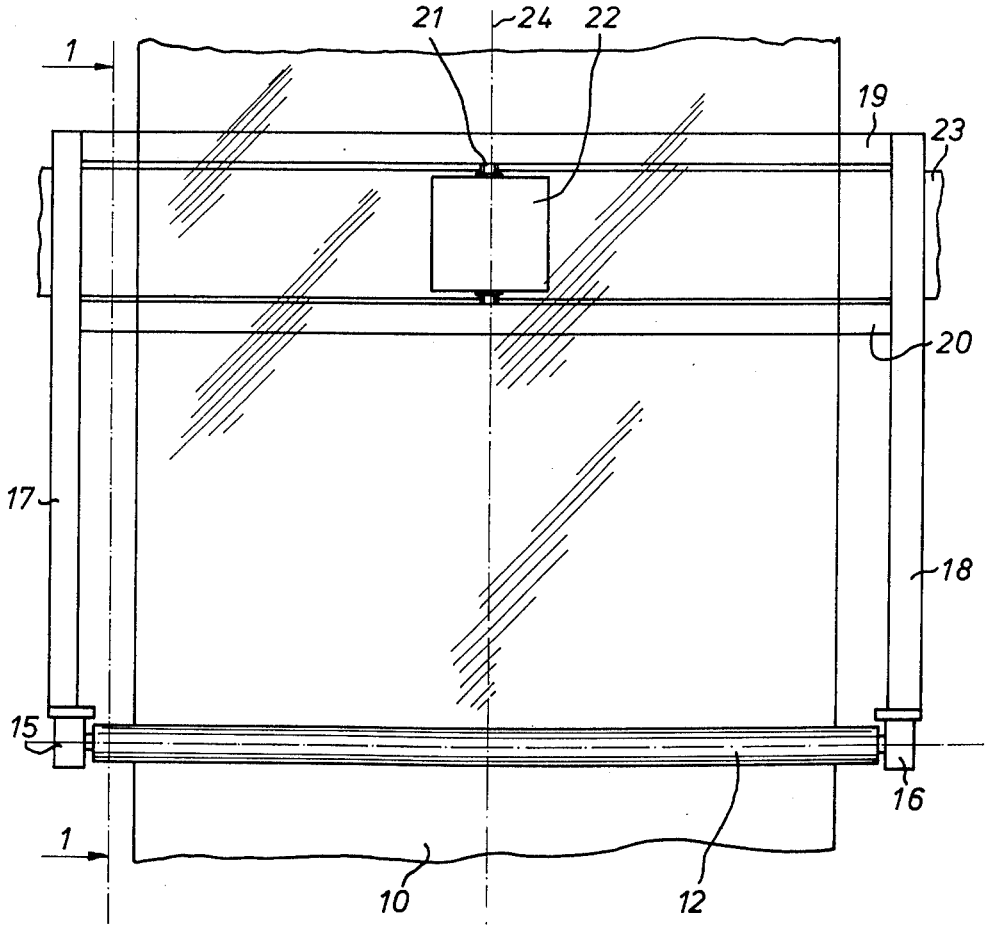

The web-handling device according to the present invention will now be described by way of example with reference to the accompanying drawings wherein:

FIG. 1 is a cross-sectional view on line 1—1 of FIG. 2 of a web-handling device according to the present invention, and FIG. 2 is a view of the device according to the arrow 2 of FIG. 1.

Referring to the diagrammatic illustration of the installation in FIG. 1, a web 10 is pulled in the direction of the arrow 14 over a web-supporting roller 11 forming part of a web coating system, a tiltable roller 12 forming part of a web-handling device according to the invention, and a web guiding roller 13. The hatching of the cross-section of roller 12 on line 1—1 of FIG. 2 has been omitted in order to not unduly mask the drawing.

The web-supporting roller 11 may be associated with an air knife extrusion or a cascade coater known in the art, which is situated at the left-hand side of the roller according to the figure, but said roller may also be integrated in another coating system, for instance, the roller 11 may be the dipping roller in a dip-coating system or such other type of coating station indicated schematically at 30 in FIG. 1.

The tiltable roller 12 is journalled for free rotation in journals 15 and 16 that are mounted on the lower extremities of two arms 17 and 18, see FIG. 2 wherein the rollers 11 and 13 have been omitted. With arms 19 and 20 the arms 17 and 18 form a rigid frame that is mounted on a shaft 21 that can rotate in a bearing block 22, mounted on a horizontal supporting beam 23. The shaft 21 is disposed centrally of the rigid frame so that the axis of tilt 24 of the frame crosses the roller 12 at a position halfway the length of said roller.

Referring again to FIG. 1, it may be seen that the web 10 is wrapped about the roller 12 over an angle $\gamma=180°-(\alpha+\beta)$. The angles $\alpha$ and $\beta$ are equal to each other so that the line 25 is the bisector of the wrapping angle of the web about the roller or, in other words, of the included angle between the upstream approach and the downstream exit plane of the web.

The axis of tilt 24 is normal to the bisector 25 since the angle $\delta = 90°$, and the intersection of the axis 24 with the bisector 25 occurs at the periphery of the roller 12 at the side of the roller where the web is in contact with the roller. Two extreme positions of one extremity of the roller which may be taken in operation of the device are illustrated by the circles in broken lines 26 and 27, respectively.

In the operation of the device, a web which is continuously unwound from a supply roll to a take-up roll to undergo a treatment at the place of roller 11, is conveyed towards the roller 12 so that the normal centre line of the approaching web coincides practically with the axis of tilt 24. Web alignment means, known in the art, and located at appropriate positions of the web path between the supply roll and the take-up roll may ensure that no substantial deviations from said described coincidence occur during the movement of the web. The position of the roller 12 as illustrated by the drawn circle in FIG. 1 does not change as long as the tension distribution across the width of the web remains uniform. However, when the uniformity of said tension distribution is destroyed, for instance in the case of a web with a surface that is deformed by slight bucklings or wrinklings that are distributed according to the longitudinal direction of the web, the roller 12 will carry out tilting movements about the axis 24 under the influence of differences in the tension forces across the web. The movements of the roller 12 compensate in fact variations of the length of the web and at any time they thereby ensure a firm contact of the web with the periphery of the web-supporting roller 11.

It has been shown that even in the extreme tilting positions of the roller 12 no lateral deviations of the web from its path occurred so that no additional measures had to be taken to control the web path, and also no extra charges were applied to existing web alignment devices.

In the described device, the angles $\alpha$ and $\beta$ amounted to 80°, and the length of the web path between the rollers 11 and 12 was less than half the length of the web path between the rollers 12 and 13.

It will be understood that these conditions are in no way restrictive for the device according to the present invention. Further, the device may also be used for the tension control of a continuously moving web of a material other than film, for instance fabric, paper or metal, which may be subjected to treatments other than coating, such as electrostatic transfer printing, corona discharging, etc.

Finally, the device may also be used in the handling of belts, or other longitudinal strip materials travelling in endless loops.

We claim:

1. A self-adjusting web-handling device for providing even tension across a continuously moving web which is conveyed by guide means to come into engagement with said handling device along an upstream approach plane and to leave said device along a downstream exit plane at a defined included angle to said approach plane, said device comprising:

a roller mounted for free rotation and engagement by said web, frame means for supporting the bearings of said roller, pivot means supporting said frame means for free pivotal movement about an axis that is situated halfway the length of the roller, that is normal to the bisector of said included angle, and that coincides with the tangent to the roller periphery at the side of the roller where the web is in engagement with the roller.

2. A web-handling device according to claim 1, in which said web guiding means includes a web supporting roller at a web-treatment station upstream of said web handling device and a web guiding roller downstream of said web-handling device.

3. A web-handling device according to claim 2, wherein the length of the web path between said web-supporting roller and said web-handling device is smaller than the distance between said device and said web guiding roller.

4. A web-handling device according to claim 2, wherein said web-treatment station is a coating station.

* * * * *